US005093643A

United States Patent [19]

Altenhof, Jr. et al.

[11] Patent Number: 5,093,643

[45] Date of Patent: Mar. 3, 1992

[54] UNDERVOLTAGE RELEASE DEVICE ASSEMBLY FOR CIRCUIT BREAKER

[75] Inventors: James N. Altenhof, Jr., West Bridgewater Boro; John J. Hoegle, Beaver; John K. Livesey, Monaca, all of Pa.

[73] Assignee: Westinghouse Electric Corp., Pittsburgh, Pa.

[21] Appl. No.: 600,896

[22] Filed: Oct. 22, 1990

[51] Int. Cl.[5] ..... H01H 83/06

[52] U.S. Cl. ..... 335/20; 335/172

[58] Field of Search ..... 335/20, 21, 167-174

[56] References Cited

U.S. PATENT DOCUMENTS 2,697,148 12/1954 Siebodnik ..... 200/106
3,919,674 11/1975 Acampora et al. ..... 335/20
4,075,584 2/1978 Castonguay et al. ..... 335/20
4,097,831 6/1978 Jencks et al. ..... 335/169
4,620,171 10/1986 Bagalini ..... 335/20
4,801,907 1/1989 Kelaita, Jr. et al. ..... 335/20
4,890,184 12/1989 Russell ..... 335/20

*Primary Examiner*—Leo P. Picard
*Assistant Examiner*—Lincoln Donovan
*Attorney, Agent, or Firm*—M. J. Moran

[57] ABSTRACT

A molded-case circuit breaker having an undervoltage release device housed therein is provided with a flexible molded double ended lever for resetting the undervoltage release device and a torsion spring braced upon the two arms of the lever so as to minimize the effects of stress and creep on the molded members when manually actuating repeatedly to reset the undervoltage release device against the biasing spring of the device.

1 Claim, 12 Drawing Sheets

UNDERVOLTAGE RELEASE DEVICE ASSEMBLY FOR CIRCUIT BREAKER

BACKGROUND OF THE INVENTION

This invention relates in general to molded-case circuit breakers and, more particularly, to an undervoltage release device assembly which is installed in such a circuit breaker.

More specifically, the invention concerns a circuit breaker known as the molded-case type, namely having a housing, or case, molded from insulating material. For the purpose of describing such a circuit breaker with an undervoltage trip mechanism embodied therein, reference is made to U.S. Pat. Nos. 2,697,148 and 4,620,171. These patents are hereby incorporated by reference.

Designing such a circuit breaker to increase its capability and generalize its application has been a challenge because of the relatively small space available within the housing of a molded-case circuit breaker, and the limits to which the overall dimensions of a circuit breaker housing can be increased without rendering the circuit breaker impractical for use in the kind of environment typical for molded-case breakers.

One main object of the present invention is to provide in a molded-case type circuit breaker an improved undervoltage release device which is reliable, requires relatively little space and has a longer useful life.

An electrical circuit breaker incorporates an operating mechanism for closing or opening the contacts in response to circuit breaker handle movement caused by external means. The circuit breaker mechanism also opens the contacts by release of a trip member in response to an overcurrent condition. The circuit breaker is provided with an undervoltage release device overriding any other operating condition in order to actuate a trip member upon the occurrence of an undervoltage condition. As generally known, the undervoltage release device, typically, comprises: an electromagnetic coil surrounding a plunger disposed axially for movement between a reset position and an actuated position, with a spring biasing the plunger toward the actuated position whenever an undervoltage condition takes away the coil's magnetic holding force and releases the bias spring. The plunger, when actuated, will engage a trip member of the circuit breaker, causing tripping of the circuit breaker. The plunger is inductively coupled with the coil inducing a magnetic force sufficient to hold the plunger in its reset position, i.e. away from the trip member, provided the coil is supplied a voltage of predetermined value. Should the voltage decrease under the limit, the force exercised upon the plunger will decrease and the biasing spring will take over, thereby moving the plunger to the actuated position. The undervoltage release device is required to embody only a few major components compactly arranged. Nevertheless, it must be capable of performing several functions. The main function is to reliably trip the circuit breaker open when an undervoltage condition occurs. In this regard, it utilizes a lever which is actuated by the handle of the circuit breaker in order to reset the plunger into its home position, against the biasing spring, as soon as the voltage applied to the coil has been restored. When the plunger is in its actuated position, i.e. under the biasing spring, the plunger is projecting outside of its core and of the coil associated cylindrical member. Resetting is effectuated by pushing with the lever the plunger back into its core and against the biasing spring. Resetting of the plunger through the lever is commanded by the handle of the circuit breaker, the lever being operatively disposed between an actuating member of the handle and an open end of the actuating plunger. The plunger open end is also used to actuate the tripping mechanism of the circuit breaker in order to translate the plunger action of the undervoltage release device into movement of the trip member of the circuit breaker.

The resetting lever of the undervoltage release device consists of thermoplastic material molded with two ends, one to receive the impact of the plunger when actuated by the undervoltage release device, the other to be actuated upon by the handle of the circuit breaker for resetting the undervoltage release device. Testing of the circuit breaker and of the undervoltage release device will put to the test the quality and effectiveness of the reset lever. Testing of the circuit breaker includes a thermal test in which the circuit breaker is soaked in an oven at an elevated temperature for an extended time period in the tripped position, then, cooled to ambient temperature with the breaker in the OFF position. Moreover, the resetting lever should be capable of going through an endurance test involving over 14,000 resetting operations. Therefore, it is important to minimize stress and creep in the resetting lever.

SUMMARY OF THE INVENTION

The invention resides in an undervoltage release device assembly for a molded-case circuit breaker having a housing containing an undervoltage release device. The assembly comprises: an undervoltage release device having a plunger axially disposed within the core of a solenoid for tripping the trip mechanism of the circuit breaker in the event of an undervoltage condition appearing upon the solenoid coil, a biasing spring for causing the plunger to move to an actuated position and trigger a trip member of the circuit breaker in the event of an undervoltage on the coil, the plunger being normally set in a home position within the core of the solenoid and held therein against the biasing spring when the plunger is inductively coupled with the coil; a two-arm thermoplastic molded lever operable in one direction of rotation for resetting the plunger with one arm into the home position against the biasing spring by actuating the other arm with the handle of the circuit breaker; and spring means mounted about the pivotal axis of said lever, and anchored upon the two arms of the lever so as to exert torsion forces oriented in opposite directions thereto upon the two arms for minimizing stress and creep thereof under long-term and repeated plunger resetting commands by the handle of the circuit breaker.

DESCRIPTION OF THE INVENTION

Figure 1:
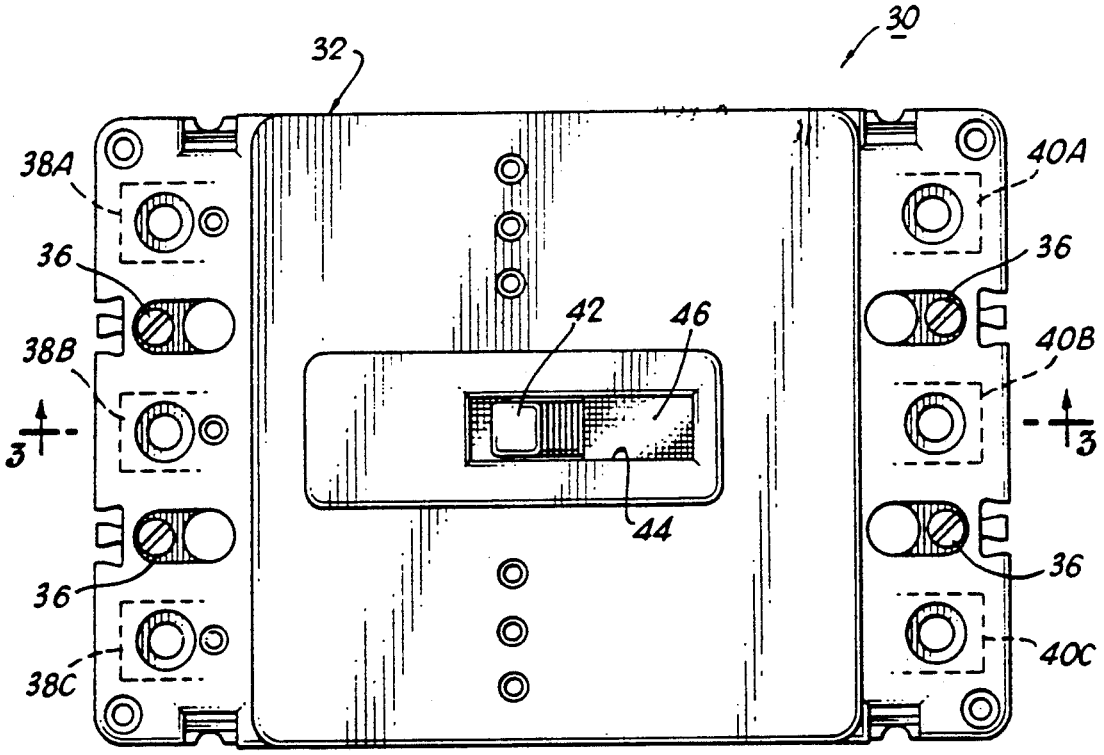
FIG. 1 PRIOR ART
FIG. 1 is a top plane view of a molded-case circuit breaker.
Figure 2:
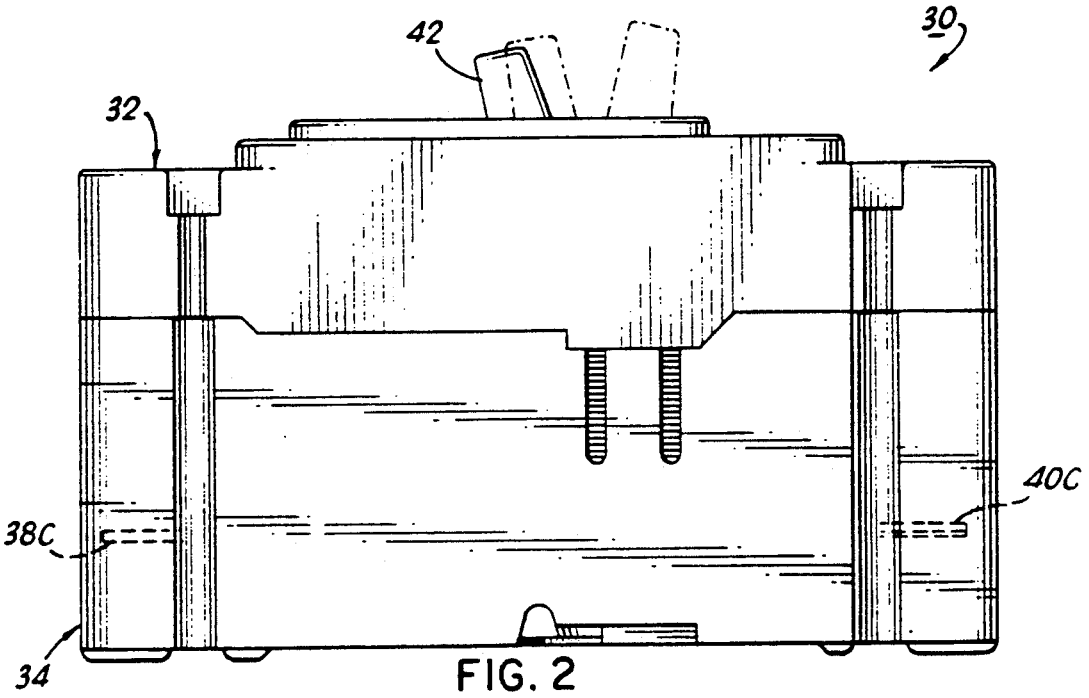
FIG. 2 PRIOR ART
FIG. 2 is a side elevational view of the device of FIG. 1.
Figure 3:
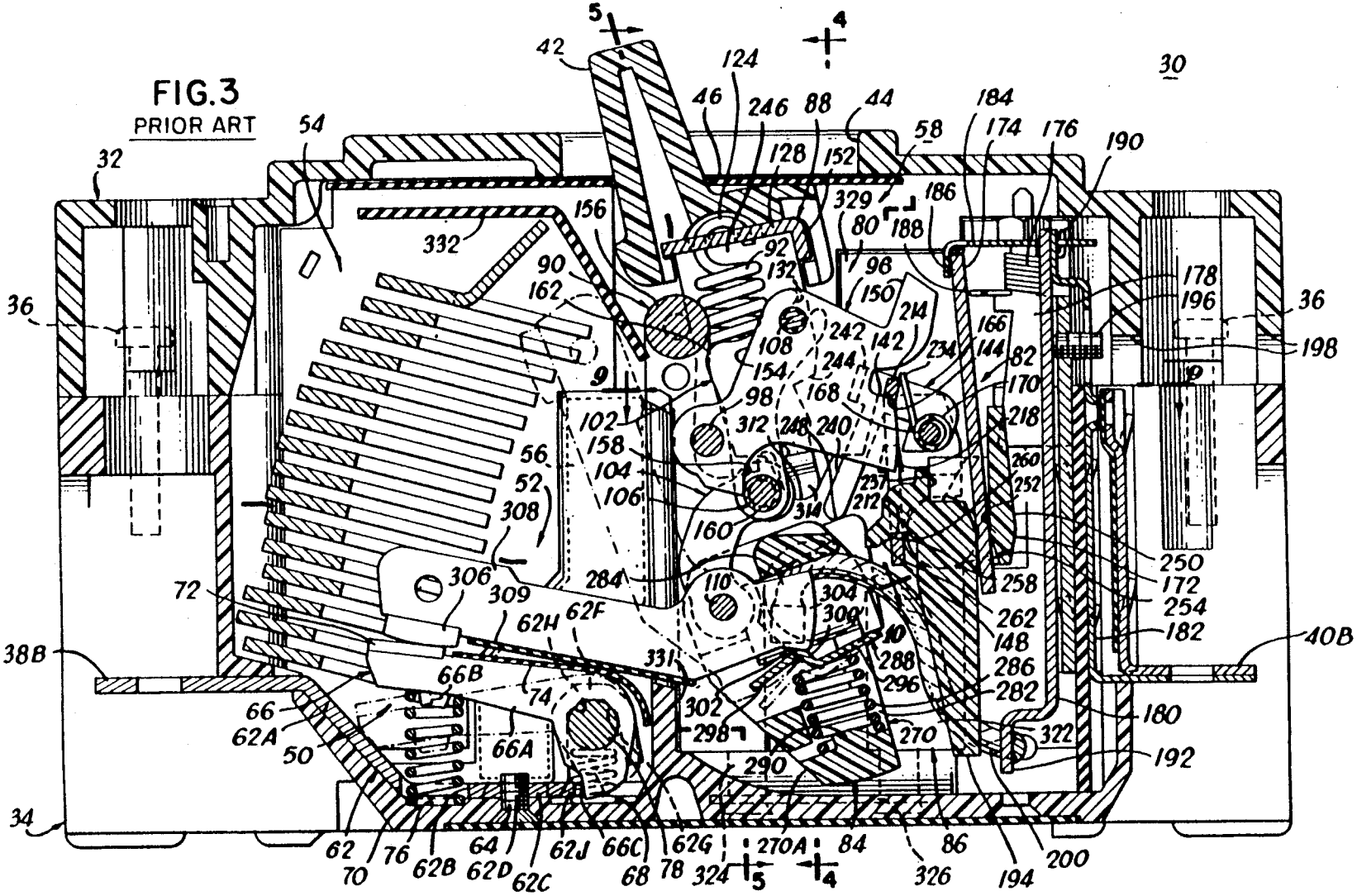
FIG. 3 PRIOR ART
FIG. 3 is an enlarged, cross-sectional view of the device of FIG. 1 taken along line 3—3 of FIG. 1, depicting the device in its CLOSED and BLOWN-OPEN positions.
Figure 5:
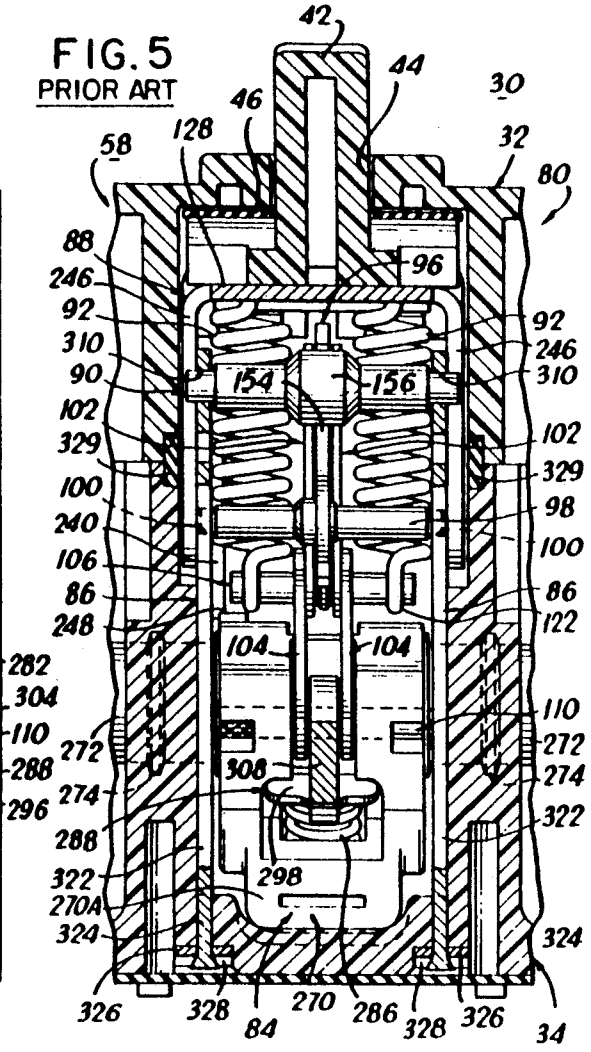
FIG. 5 PRIOR ART
FIG. 5 is an enlarged, fragmentary, cross-sectional view of the center pole of the device of FIG. 1 taken along line 8—8 of FIG. 3.
Figure 4:
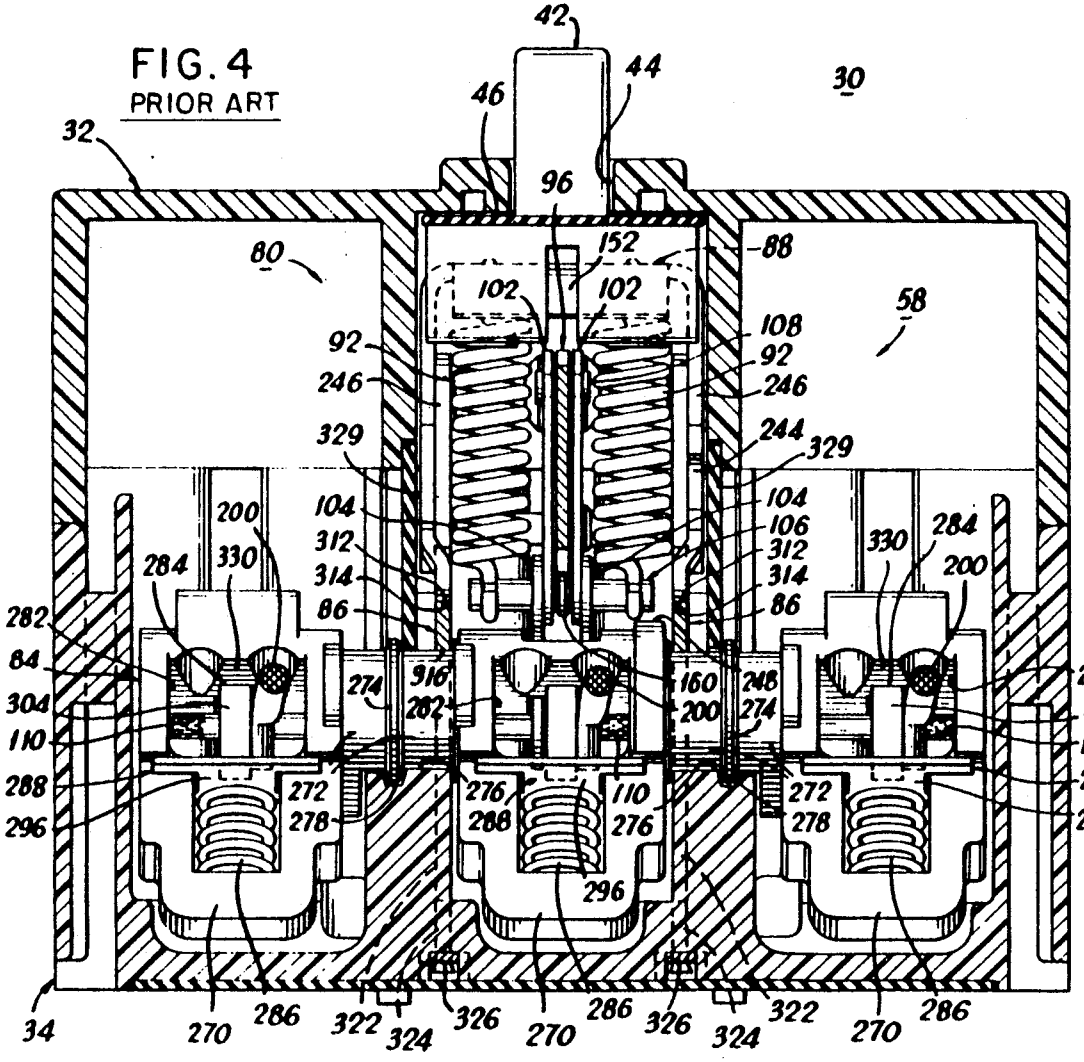
FIG. 4 PRIOR ART
FIG. 4 is an enlarged, cross-sectional view of the device of FIG. 1 taken along line 7—7 of FIG. 3.
Figure 8:
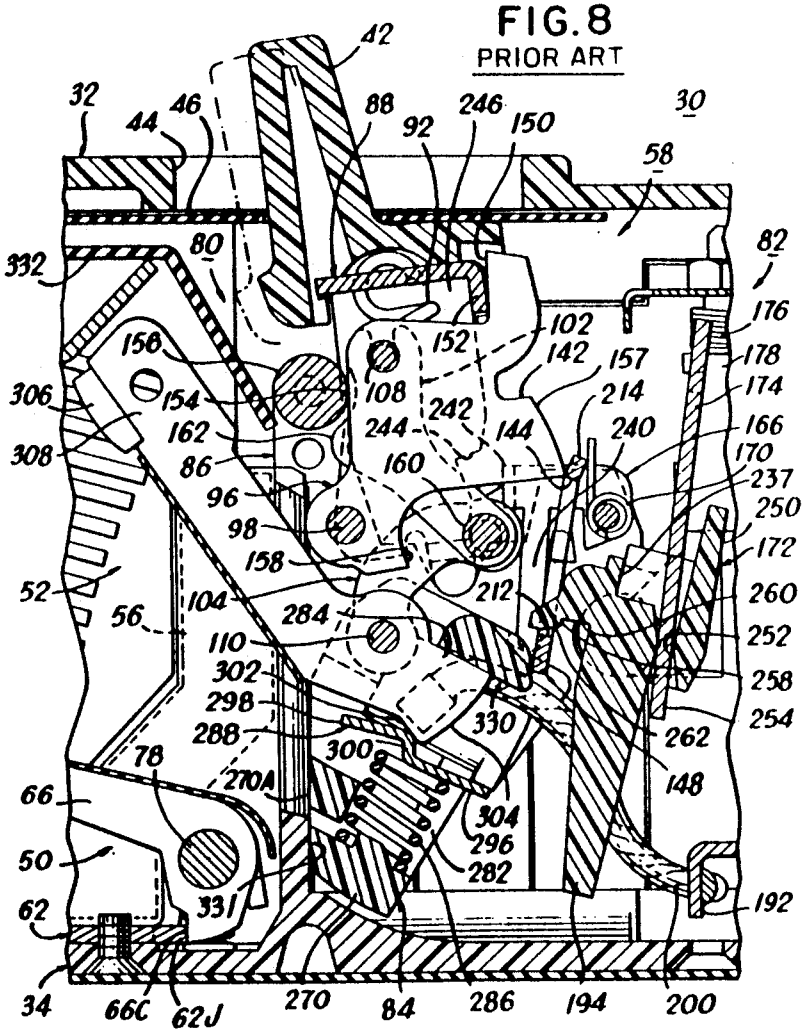
FIG. 8 PRIOR ART
FIG. 8 is an enlarged, fragmentary, cross-sectional view of the center pole of the device of FIG. 1, depicting the device in its TRIPPED position.
Figure 7:
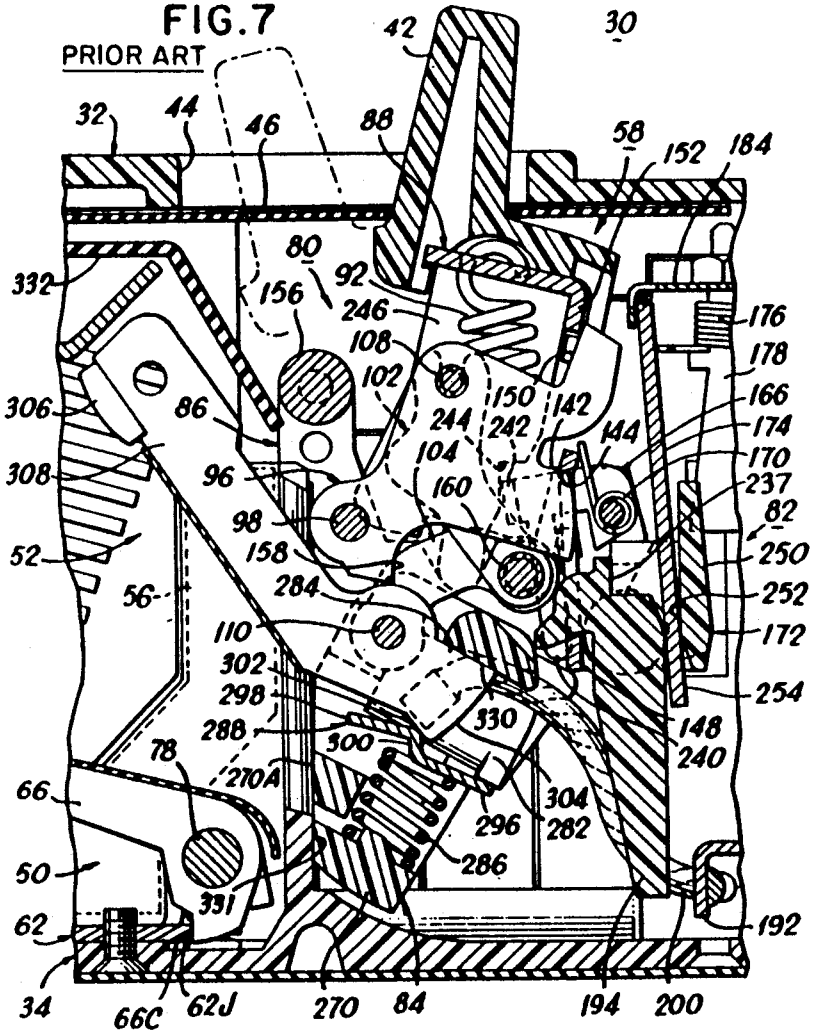
FIG. 7 PRIOR ART
FIG. 7 is an enlarged, fragmentary, cross-sectional view of the center pole of the device of FIG. 1, depicting the device in its OPEN position.

FIGS. 1 and 2 show a three-phase, molded-case circuit breaker 30 wherein a molded insulating housing includes a cover 32 and a base 34 secured to each other by means of fasteners 36. A plurality of first electrical terminals 38A, 38B and 38C are provided, one for each pole or phase, and a plurality of second electrical terminals or load terminals 40A, 40B and 40C. The circuit breaker 30 further includes an electrically insulating, rigid, manually engageable handle 42 extending through an opening 44 in the top cover 32 for setting the circuit breaker 30 to its CLOSED position (FIG. 3), or to its OPEN position (FIG. 7). The circuit breaker 30 may also assume a BLOWN-OPEN position (FIG. 3, dotted line position), or a TRIPPED position (FIG. 8). Subsequently to being placed in its TRIPPED position, the circuit breaker 30 may be reset for further protective operation by moving the handle 42 from its TRIPPED position (FIG. 8) past its OPEN position (FIG. 7). The handle 42 may then be left in its OPEN position (FIG. 7) or moved to its CLOSED position (FIG. 3), in which case the circuit breaker 30 is ready for further protective operation. The movement of the handle 42 may be achieved either manually by an operator, or automatically by a machine actuator. Preferably, an electrically insulating strip 46, movable with the handle 42, covers the bottom of the opening 44 and serves as an electrical barrier between the interior and exterior of the circuit breaker 30.

The structural and functional characteristics of the circuit breaker of FIGS. 3 to 8 are fully described in the incorporated-by-reference U.S. Pat. No. 4,620,171. The circuit breaker 30 includes a lower electrical contact 50 and an upper electrical contact 52, controlled to be closed, or open, by an operating mechanism. The operating mechanism 58 comprises: an overcenter toggle mechanism 80; a trip mechanism 82; an integral or one-piece molded cross bar 84; a pair of rigid, opposed or spaced apart, metal side plates 86; a rigid, pivotable, metal handle yoke 88; a rigid stop pin 90; and a pair of operating tension springs 92. The overcenter toggle mechanism 80 is associated with a rigid, metallic cradle 96 rotatable about the longitudinal central axis of a support pin 98. The opposite longitudinal ends of the cradle support pin 98 are retained in a pair of apertures 100 formed through the side plates 86. The toggle mechanism 80 further includes a pair of upper toggle links 102, a pair of lower toggle links 104, a toggle spring pin 106 and an upper toggle link follower pin 108. The lower toggle links 104 are secured to the upper electrical contact 52 by a toggle contact pin 110. Each of the lower toggle links 1 04 includes a lower aperture 112 for receipt therethrough of the toggle contact pin 110. The toggle contact pin 110 also passes through an aperture 114 formed through the upper electrical contact 52 enabling the upper electrical contact 52 to freely rotate about the central longitudinal axis of the pin 110. The opposite longitudinal ends of the pin 110 are received and retained in the cross bar 84. Thus, movement of the upper electrical contact 52, under other than high level short circuit or fault current conditions, and the corresponding movement of the cross bar 84 are effected by movement of the lower toggle links 104. Accordingly, due to the central rigid crossbar 84, movement of the upper electrical contact 52 by the operating mechanism 58 in the center pole or phase of the circuit breaker 30 will simultaneously cause the same movement in the upper electrical contacts 52 associated with the other poles or phases of the circuit breaker 30.

The upper links 102 include recesses or grooves 132 receiving and retaining a pair of spaced apart journals 134 formed along the length of the pin 108. The center portion of the pin 108 is configured to be received in an aperture 136 formed through the cradle 96 at a location spaced by a predetermined distance from the axis of rotation of the cradle 96. Spring tension from the springs 92 retains the pin 108 in engagement with the upper toggle links 102. Thus, rotational movement of the cradle 96 effects a corresponding movement or displacement of the upper portions of the links 102.

The cradle 96 includes a slot or groove 140 having an inclined flat latch surface 142 formed therein. The surface 142 is configured to engage an inclined flat cradle latch surface 144 formed at the upper end of an elongated slot or aperture 146 formed through a generally flat, intermediate latch plate 148. The cradle 96 also includes a generally flat handle yoke contacting surface 150 configured to contact a downwardly depending elongated surface 152 formed along one edge of the upper surface 128 of the handle yoke 88. The operating springs 92 move the handle 42 during a trip operation; and the surfaces 150 and 152 locate the handle 42 in a TRIPPED position (FIG. 8), intermediate the CLOSED position (FIG. 3) and the OPEN position (FIG. 7) of the handle 42, to indicate that the circuit breaker 30 has tripped. In addition, the engagement of the surfaces 150 and 152 resets the operating mechanism 58 subsequent to a trip operation by moving the cradle 96 in a clockwise direction against the bias of the operating springs 92 from its TRIPPED position (FIG. 8) to and past its OPEN position (FIG. 7) to enable the relatching of the surfaces 142 and 144.

The cradle 96 further includes a generally flat elongated stop surface 154 for contacting a peripherally disposed, radially outwardly protuberant portion or rigid stop 156 formed about the center of the stop pin 90. The engagement of the surface 154 with the rigid stop 156 limits the movement of the cradle 96 in a counterclockwise direction subsequent to a tripped operation (FIG. 8). The cradle 96 also includes a curved, intermediate latch plate follower surface 157 for maintaining contact with the outermost edge of the inclined latch surface 144 of the intermediate latch plate 148 upon the disengagement of the latch surfaces 142 and 144 during a trip operation (FIG. 8). An impelling surface of kicker 158 is also provided on the cradle 96 for engaging a radially and outwardly projecting portion or contacting surface 160 formed on pin 106 upon the release of the cradle 96, so as to immediately and rapidly propel the pin 106, along a counterclockwise arc, from an OPEN position (FIG. 3) to a TRIPPED position (FIG. 8), thereby rapidly raising and separating the upper electrical contact 52 from the lower electrical contact 50.

Figure 6:
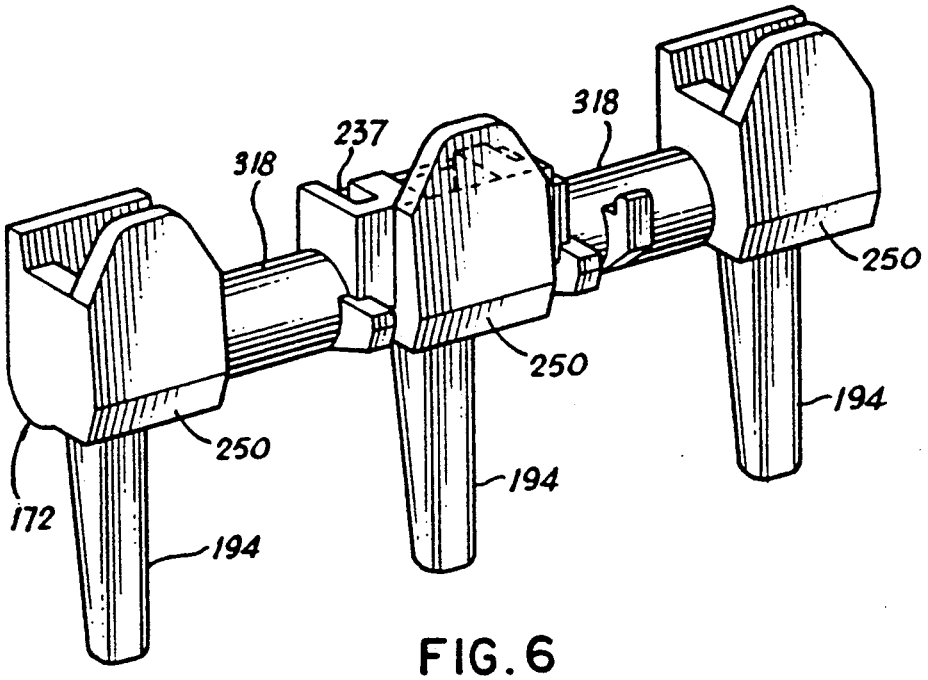
FIG. 6 PRIOR ART
FIG. 6 is an enlarged, perspective view of the trip bar of the device of FIG. 1.

As shown in FIG. 6, the trip bar 172 is formed as a molded, integral or one-piece bar 318 having three spaced apart downwardly extending contact legs 194, one for a corresponding pole or phase of the circuit breaker 30. In addition, bar 318 carries, for each pole or phase, three armature support sections 250 each defining an elongated and generally of rectangular shape pocket 252 for receiving a downwardly extending leg 254 belonging to the armature 174 (FIGS. 7 and 8). The armature 174 has outwardly extending edges or shoulder portions engaging the upper surfaces of pockets 252 to properly seat the armature 174 within the trip bar 172. Each leg 254 is designed so as to engage and impel the rotation of an associated contact leg 914 of the trip bar 172 in a clockwise direction (FIG. 8), upon the occurrence of a short circuit, or fault current condition.

The trip bar 172 also includes a latch surface 258 (FIG. 3) provided for engaging and latching the trip bar latch surface 212 of the intermediate latch plate 148. The latch surface 258 is disposed between a generally horizontally disposed surface 260 and a separate, inclined surface 262 of the trip bar 172. The latch surface 258 (FIG. 3) is a vertically extending surface having a length determined by the desired response characteristics of the operating mechanism 58 to an overload condition or to a short circuit or fault current condition. Typically, an upward movement of the surface 260 of approximately one-half millimeter is sufficient to unlatch the surfaces 258 and 212. Such unlatching results in movement between the cradle 96 and the intermediate latch plate 148 along the surfaces 142 and 144, immediately unlatching the cradle 96 from the intermediate latch plate 148 and enabling the counterclockwise movement of the cradle 96, thus, a trip operation of the circuit breaker 30. During a reset operation, the spring arm 236 of the torsion spring 170 engages the surface 237 of the trip bar 172, causing the surface 237 to rotate counterclockwise to enable the latch surface 258 of the trip bar 172 to engage and relatch with the latch surface 212 of the intermediate latch plate 148, thereby to reset the intermediate latch plate 148, the trip bar 172 and the circuit breaker 30. The length of the curved surface 157 of the cradle 96 should be sufficient to retain contact between the upper portion 214 of the intermediate latch plate 148 and the cradle 96 so as to prevent resetting of the intermediate latch plate 148 and the trip bar 172 until the latch surface 142 of the cradle 96 is positioned below the latch surface 144 of the intermediate latch plate 148.

Figure 9:
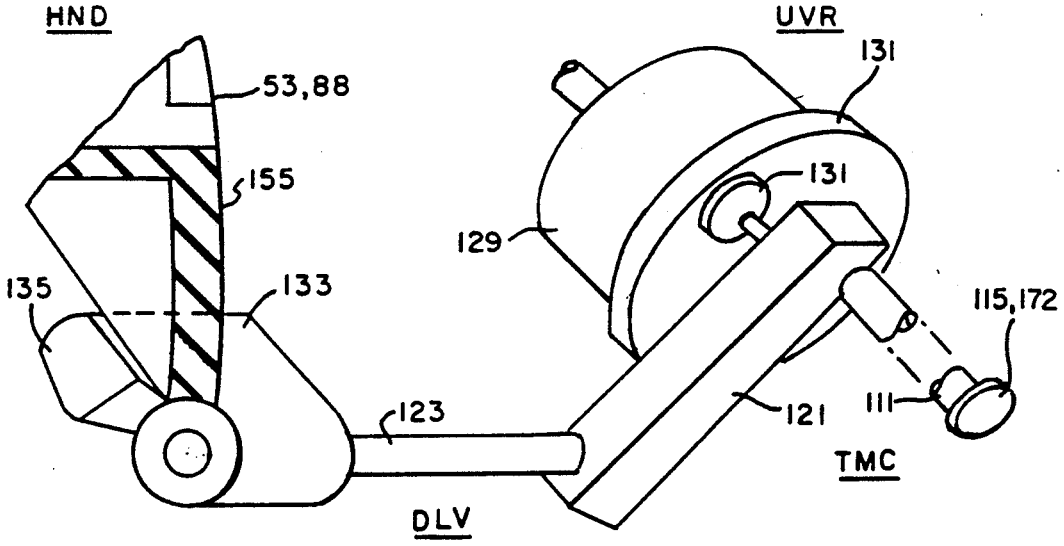
PRIOR ART FIG. 9
FIG. 9 shows a double arm lever of the prior art as is used between the handle of the switch breaker and the undervoltage release device associated therewith for controlling the tripping mechanism thereof.

FIG. 9 is a prior art representation, of a double arm lever DLV, according to the incorporated by reference U.S. Pat. No. 2,697,148. The double arm lever is interposed between the handle HDL and an undervoltage release device UVR used for actuating the tripping mechanism TMC of the circuit breaker. For the purpose of incorporating herein the description of the '148 patent, the same numeral references are used in FIG. 9 as in the patent. Thus, FIG. 9 shows the arm 53 (88 in FIGS. 7 and 8) abutting (by its end member 155) the end 135 of one arm 133 of the double lever DLV. The two arms 133 and 121 are mounted on a common shaft 123. The other arm 121 engages with a front part 129 the disk 131 which represents the end of a plunger 109 pertaining to the electromagnetic coil of the undervoltage release device UVR. When the voltage of the coil drops, the biasing spring (not shown) of the device pushes the plunger out of its core and the arm 121 of the double lever DLV will actuate a rod 111 which, by its end member 115, will actuate the trip bar (172 in FIGS. 7 and 8) of the circuit breaker. According to the present invention, under imposed restrictions, and with the confinement of the parts in the circuit breaker of FIGS. 1 and 2, instead of the hardware implementation of the double arm lever shown in FIG. 9, a thermoplastic molded one-piece double-ended lever (shown in FIGS. 10 to 14C) is proposed having a torsion spring SP associated to it for strength and flexibility, improved thermal efficiency and long life, while minimizing structural parts and space.

Figure 10:
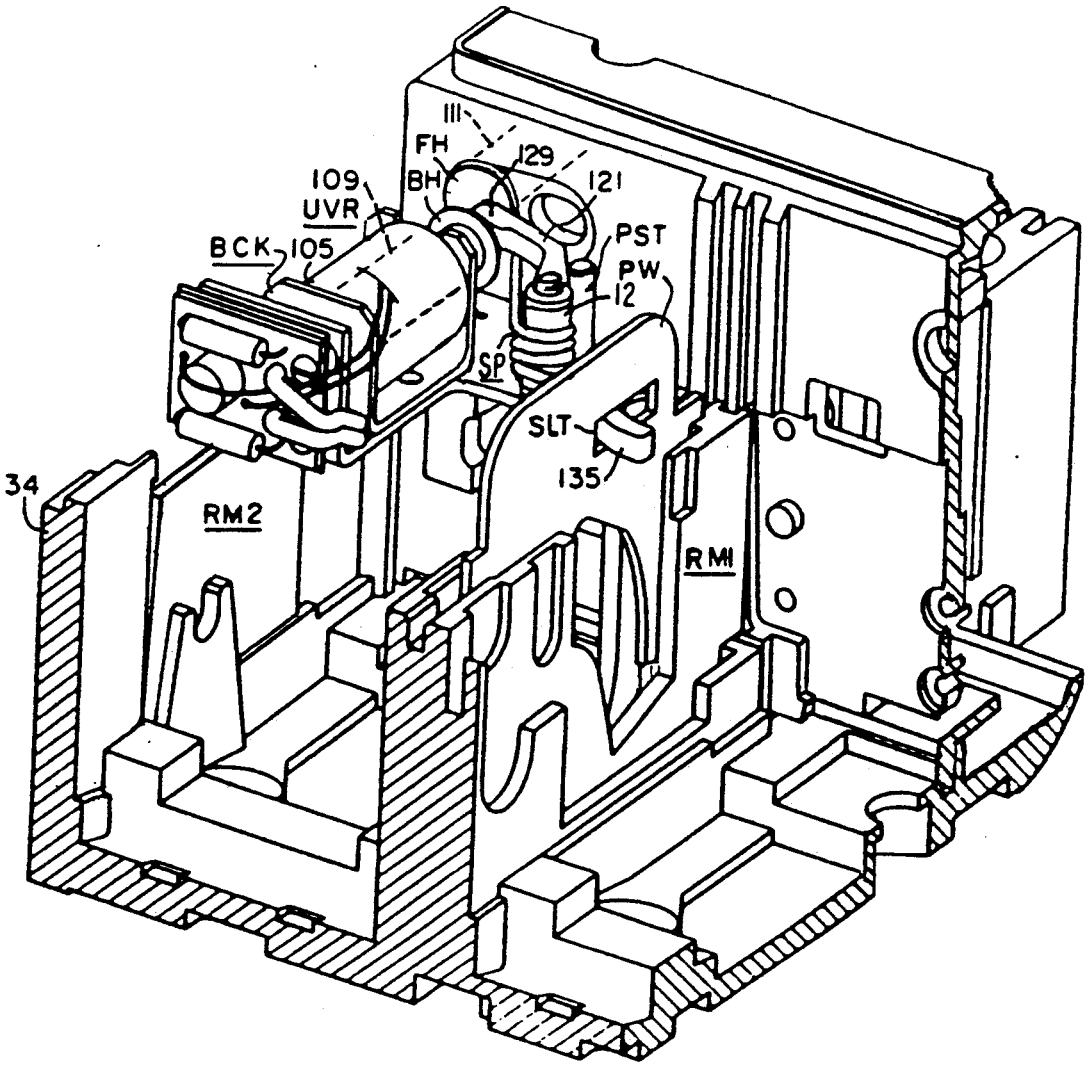
FIG. 10 shows the undervoltage release device with the one-piece flexible double-ended lever according to the present invention, as installed within the circuit breaker housing for the right pole of a multipole circuit breaker.
Figure 11:
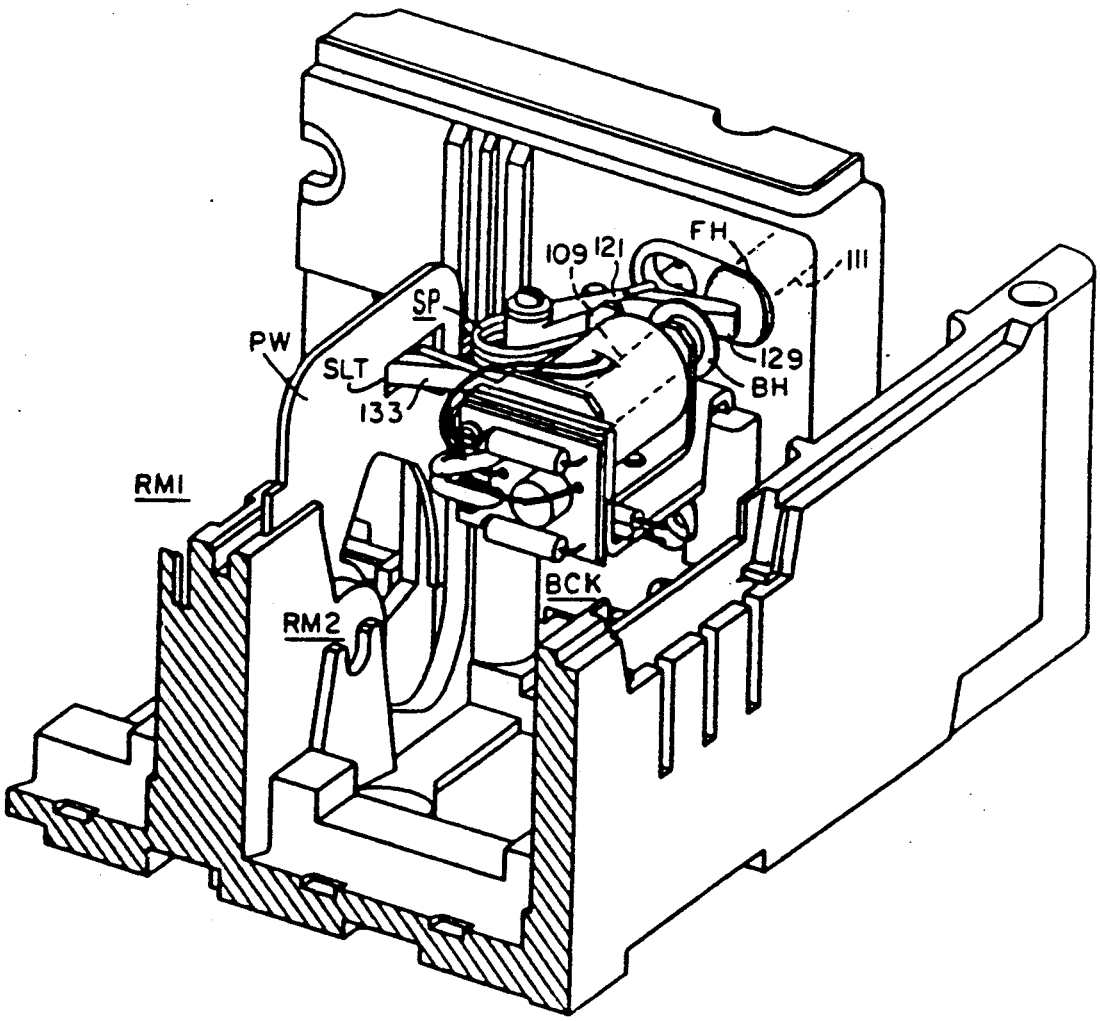
FIG. 11 is like FIG. 10 for a left pole installation on the circuit breaker.
Figure 12:
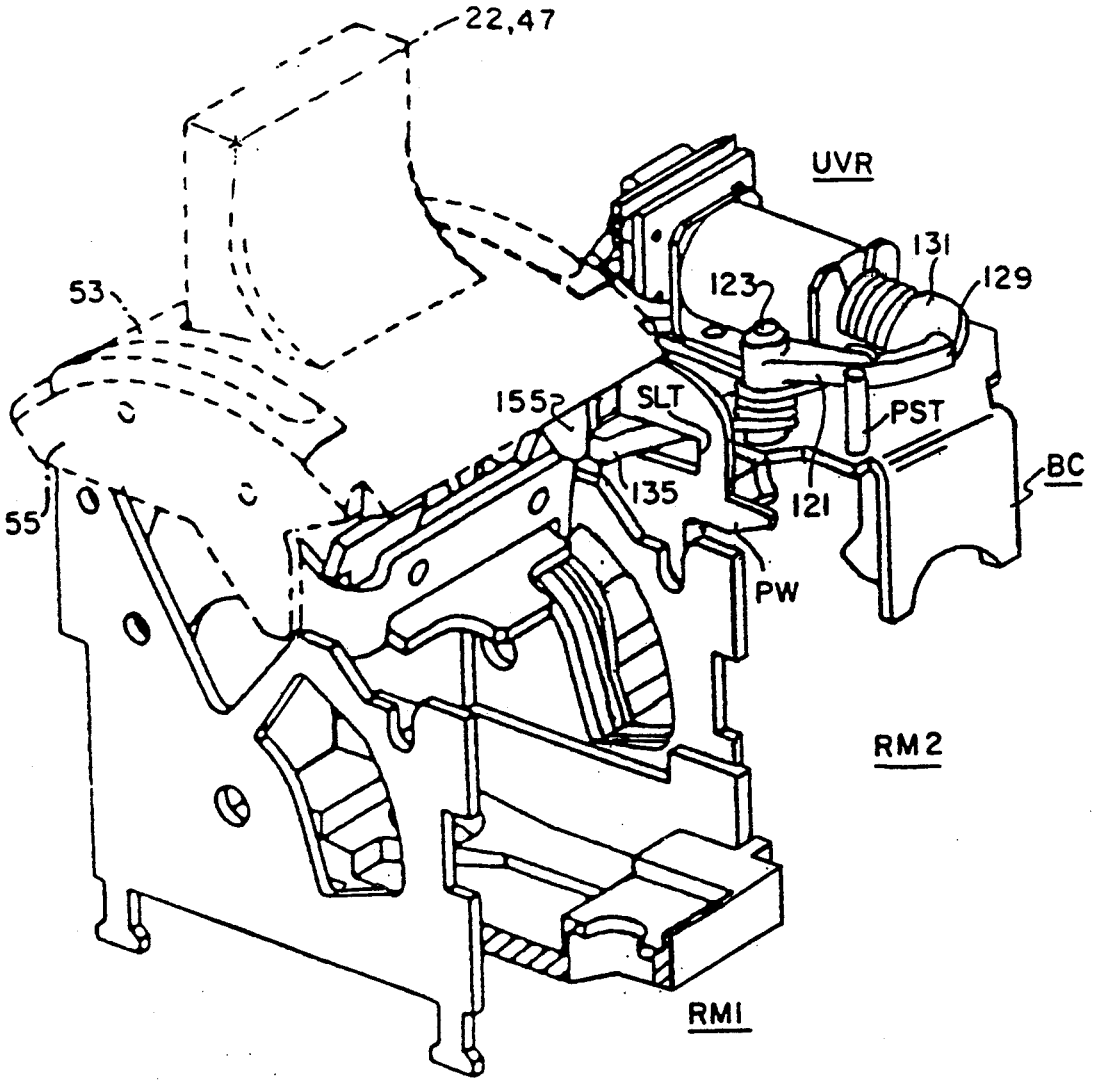
FIG. 12 illustrates the relationship between the breaker handle and the double-ended lever according to the present invention.

As shown in FIG. 10, or FIG. 11, the circuit breaker embodying the invention includes a resettable undervoltage release device UVR installed in a side room RM2, nearby room RM1 which in the common housing is reserved for the tripping mechanism of the circuit breaker. In FIG. 10, the UVR device is shown installed with the right pole of a multipole circuit breaker, whereas in FIG. 11 it is installed with the left pole. The UVR device is positioned on a bracket BCK in the adjoining room RM2 on the other side of a partition wall PW having a slot SLT used to allow the end 135 of the arm 133 of a double-ended lever to be passed therethrough. Thus, the UVR device comprises a solenoid having a coil 105 and a plunger 109 biased away from its home position by a spring 117. The plunger 109 has a front end 131 facing the end 129 of the first arm 121 of a double-ended lever having a common shaft 123 and a second arm 133 having an end 135. The double-ended lever is used to reset the plunger 109 to its home position within the core of the UVR electromagnetic coil 105 and against the force of the biasing spring 117. FIG. 12 shows how the arm 53 of the handle (22, 47) of the circuit breaker is used to reset the double lever of the UVR device. The arm 53 of the handle has a member 155 which, when actuated, will push the end 135 of the arm 133 of the double lever from the other side of the slot SLT existing in the partition wall PW. The bracket BCK possesses a post PST which will stop the arm 121 in its extreme position after actuation by the biasing spring 117 of plunger 109.

Figure 13B:
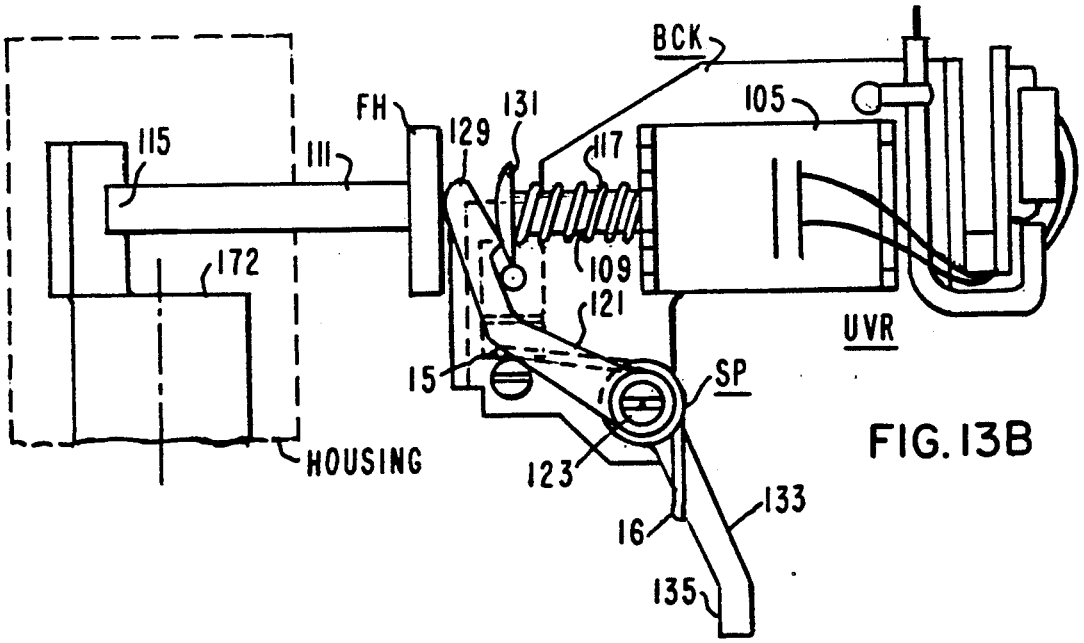
FIG. 13B is a side view corresponding to FIG. 13A.
Figure 13A:
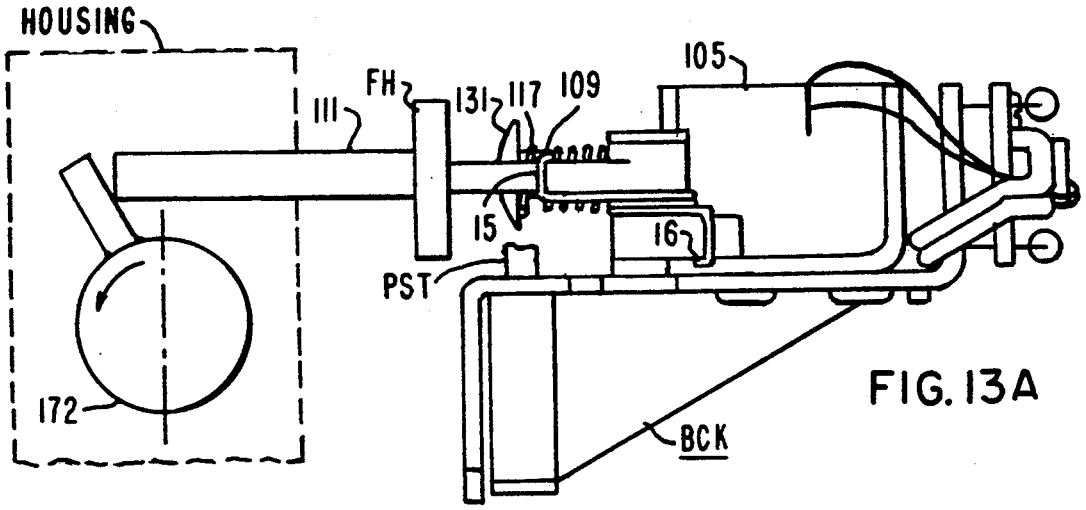
FIG. 13 A is a front view of the undervoltage release device in its actuated position and mounted on its bracket, the view being chosen to emphasize the relation of the double-ended lever: 1. with the plunger and its biasing spring for resetting; and 2. with the intermediate plunger and trip bar when actuated.
FIG. 13C is another side view corresponding to FIG. 13A.
Figure 13C:
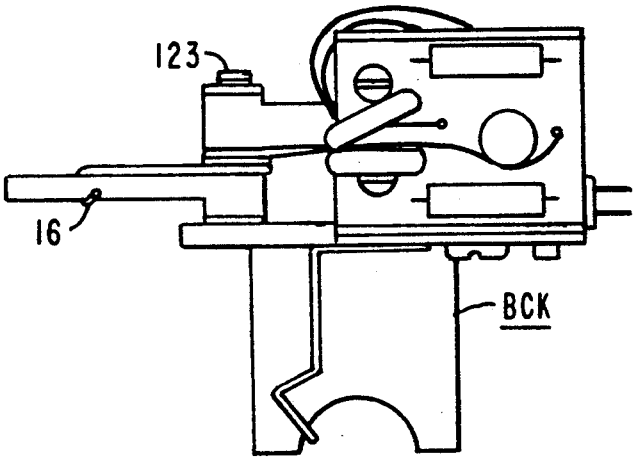

Typically, as shown in FIGS. 13A to 13C, the end of plunger 109 is in the form of a button 131 facing the end 129 of arm 121. When the voltage across the coil 105 drops too low, the plunger 109 is no longer being held in its home position, and the biasing spring 117 projects the button head 131 of the plunger against end 129 of the first arm, in turn pushing the flat end FH of the intermediate plunger 111 which at its other end engages and actuates the trip bar (172 in FIGS. 7 and 8) of the circuit breaker, thereby causing the latching mechanism to release the circuit breaker mechanism and the moving contacts to be pulled open by the associated mechanism springs. FIGS. 13A to 13C show the undervoltage release device in the actuated position, thus, before resetting by the double ended lever DLV.

Following a tripping operation caused by an undervoltage condition sensed by the undervoltage release device, the circuit breaker 30 cannot be immediately reset in the manner previously described herein, unless normal voltage is re-applied to the coil 105. This is due to the fact that the compression spring 117 will continue to hold the plunger 109 in its actuated position, hence causing the trip bar to remain in the trip position for as long as plunger 109 has not been replaced in its home position. Consequently, resetting of the circuit breaker requires that voltage to the solenoid coil be restored. Then, the undervoltage trip device must be reset, which is accomplished, as seen from FIG. 12, by actuating the handle (22,47) so as to force arm 53 and member 155 against button head 131.

Figure 14:
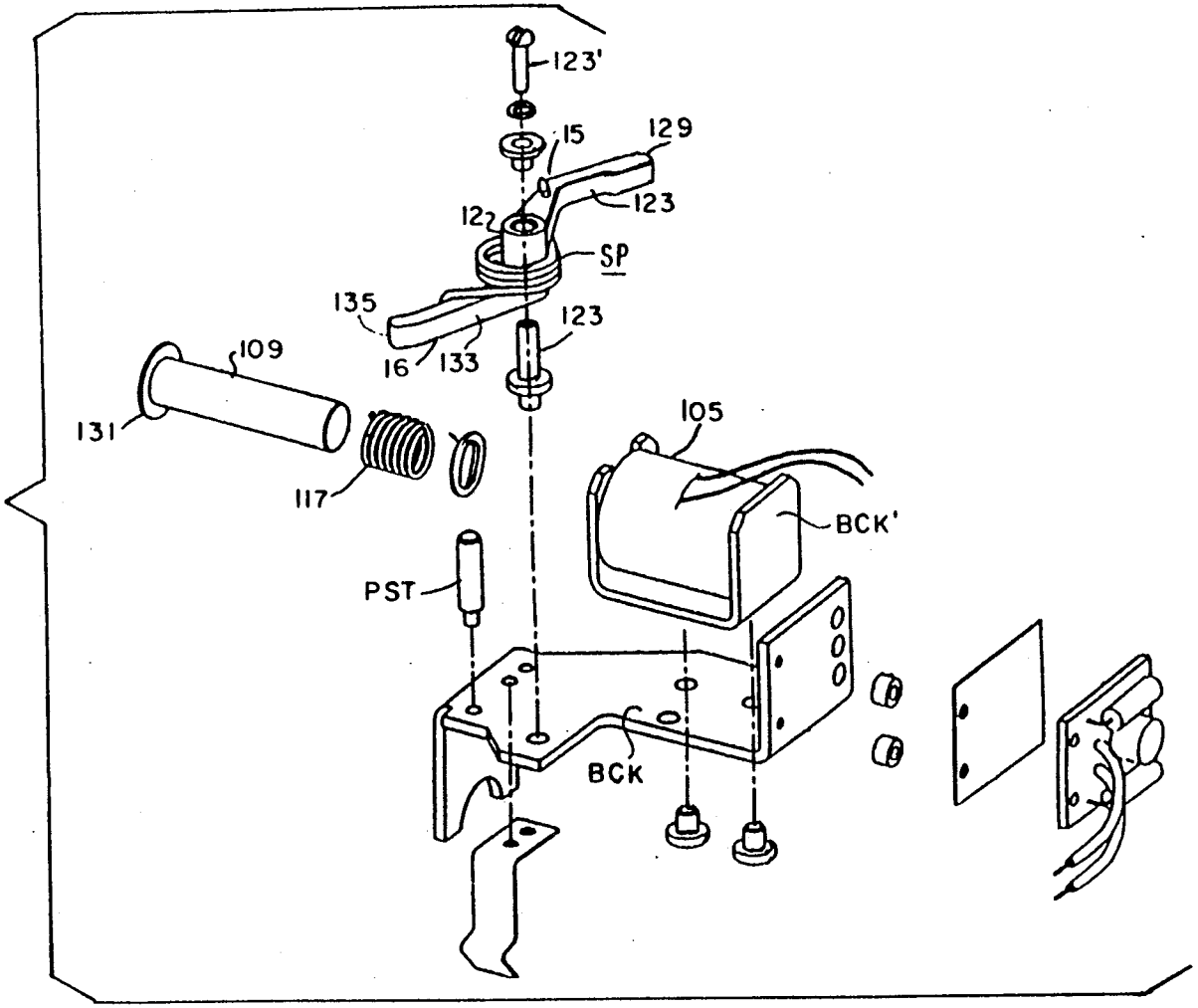
FIG. 14 is an exploded view of the undervoltage release device showing coil, plunger, double ended lever and accessory parts, as well as the spring pertaining, according to the present invention, to the double ended lever.

FIG. 14 is an exploded view of the installed undervoltage device with the double ended lever according to the present invention. The latter is a one-piece molded lever of thermoplastic material having two arms 121 and 133. One arm has an end 135 used for resetting by the handle end piece (155 in FIG. 12), the second arm has an end 129 used to face the button head 131 of the plunger 109. Those two arms are integral with a cylindrical and central portion 12 which pivots on shaft 123. Screw 123' is used for securing the lever to the shaft. Around the cylindrical portion 12 is mounted a spring SP having two ends derived from the main turns, each disposed along a corresponding arm, then hooked over, at 15 for arm 121, at 16 for arm 133, so as to brace the spring to the body of the lever and provide anchoring. Otherwise, plunger 109 is mounted within the core of the solenoid 105 with the bias spring 117. The voltage applied to the coil will hold the plunger inside, once it has been reset therein. The solenoid is mounted on an auxiliary bracket BCK' which is held by bracket BCK which is mounted in locating slots of the trip unit within room RM2 of the housing, as shown earlier by FIG. 12. A post PST is provided in order to limit the movement of lever 133 upon actuation by the plunger 109. The double-ended lever DLV consists of a single-piece molded body of thermoplastic material defining the two opposite arms 121 and 133. According to the present invention, a spring is wound around the cylindrical and central portion CP which surrounds the shaft 123, and the two ends of such spring are hooked over the associated arm to provide anchoring.

Figure 15A:
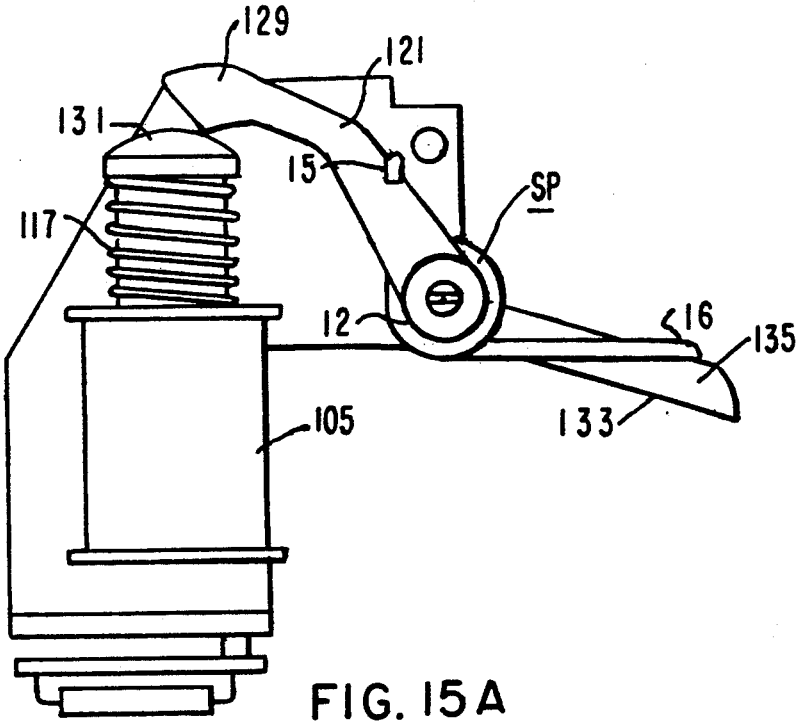
FIGS. 15A and 15B are a top and a side view of the resetting lever shown with its mounted spring, according to the present invention.
Figure 15B:
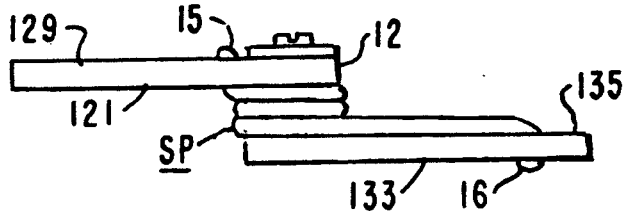

FIGS. 15A and 15B, illustrate separately the double-ended lever with its associated torsion spring SP in a front view and a side view. This spring arrangement is provided as a brace for the molded member so as to strengthen the arms which are repeatedly experiencing stresses due to the opposite torsional forces exerted between arms 121 and 133 under actuation by the biasing spring 117, as under the resetting action with the handle. As a result, stress and creep in the molded member used as a lever for resetting of the undervoltage release device is considerably reduced, thereby insuring a longer life for the equipment. In addition, the tension spring SP is easily assembled to the cylindrical portion 12 on the lever arms, without demanding additional room for installation.

We claim:

1. In a molded-case circuit breaker having a handle for manually disconnecting and reconnecting a fixed and a moveable electrical contact through a tripping mechanism, and an undervoltage release device having an electromagnetic coil, a plunger and a biasing spring for said plunger, said plunger being moveable from a home position under said coil to an actuated position under said biasing spring when there is an undervoltage condition upon said coil; the combination of:

a one-piece double lever of thermoplastic molded material mounted on a central shaft and having two opposite radially extending arms; a bracing torsion spring centrally disposed and having extensions anchored upon said lever arms; one of said arms being rotated in response to one end of said plunger being moved by said plunger under the biasing spring from the home position to the actuated position; the other of said arms being associated with said tripping mechanism for actuation thereof through rotation of said one arm by said plunger;

said handle being mechanically coupled to said double lever other arm for resetting said plunger into the home position by counter-rotation of said one arm when reconnecting said contacts with said handle;

whereby the double lever operates alternately and successively to actuate said trip mechanism upon the occurrence of an undervoltage condition in said undervoltage release device and to reset said undervoltage release device after the undervoltage condition has lapsed.

* * * * *